United States Patent [19]

Artzberger

[11] Patent Number: 4,784,519

[45] Date of Patent: Nov. 15, 1988

[54] DIRECTIONAL CONTROL MECHANISM FOR SURFACE WORKING MACHINE

[75] Inventor: Thomas G. Artzberger, Menomonee Falls, Wis.

[73] Assignee: M-B-W Inc., Slinger, Wis.

[21] Appl. No.: 30,368

[22] Filed: Mar. 26, 1987

[51] Int. Cl.[4] ..... E01L 19/22; E01L 19/42

[52] U.S. Cl. ..... 404/112; 51/177

[58] Field of Search ..... 404/112, 97; 15/87; 51/177

[56] References Cited

U.S. PATENT DOCUMENTS

| | | | |
|---|---|---|---|
| 2,389,798 | 11/1945 | Main | 244/17 |
| 2,624,250 | 1/1953 | Bird | 404/112 |
| 2,869,442 | 1/1959 | Mincher | 404/112 |
| 2,887,934 | 5/1959 | Whiteman | 404/112 |
| 3,080,002 | 3/1963 | DuPont | 170/160.26 |
| 3,412,657 | 11/1968 | Colizza et al. | 404/112 |
| 3,936,212 | 2/1976 | Holz, Sr. | 404/112 |
| 4,046,484 | 9/1977 | Holz, Sr. | 404/112 |
| 4,312,603 | 1/1982 | Whiteman, Jr. | 404/112 |
| 4,358,123 | 11/1982 | Richards | 280/47.13 |
| 4,367,880 | 1/1983 | Harding | 280/47.13 |

*Primary Examiner*—Jerome W. Massie, IV

*Assistant Examiner*—John F. Letchford

*Attorney, Agent, or Firm*—Andrus, Sceales, Starke & Sawall

[57] ABSTRACT

A directional control mechanism for a surface working machine. The surface working machine includes a frame that carries at least a pair of rotors each having a vertical rotatable shaft. Surface working means, including a plurality of radially extending blades, is operably connected to the shaft and rotates therewith. Each blade is mounted for tilting movement with respect to the rotor shaft about a horizontal axis and by simultaneously tilting the blades about the respective horizontal axes, the pitch of the blades can be varied. In addition, a second operating mechanism is included for individually tilting the blades of each rotor as the rotor rotates to effect directional control of the machine.

14 Claims, 2 Drawing Sheets

DIRECTIONAL CONTROL MECHANISM FOR SURFACE WORKING MACHINE

BACKGROUND OF THE INVENTION

Walk-behind trowelling machines incorporate a rotor that carries a plurality of surface working members or trowelling blades. To provide directional movement of the machine over the surface to be trowelled, the operator manually exerts a force on the handle to tilt the machine and apply downward pressure at specific locations on the periphery of the machine to obtain the desired directional movement.

Riding-type trowelling machines have also been utilized, which incorporate two or more rotors, each of which carries a plurality of trowelling blades. As described in U.S. Pat. Nos. 3,936,212 and 4,046,484, directional movement of the riding-type trowelling machine is achieved by a mechanism, in which each rotor is hinged to the frame and the operator applies selective downward tilting pressure to specific locations on the guard rings that surround each rotor. The pressure is applied by a complicated linkage system actuated by a control stick and foot pedals. Through this system, the rotors can be individually tilted with respect to the frame to cause directional movement of the machine over the surface.

With the directional control system as described in the aforementioned patents, the operator must continually apply pressure to the hand and foot controls to cause directional movement of the machine. The continual application of pressure can be fatiguing to the operator over an extended period of time.

In the conventional trowelling machine, a pitch control mechanism is employed to vary the pitch or angularity of the trowelling or blades with respect to the surface to be finished. To provide the pitch control, each blade is carried by a sleeve, which can be rotated around a radially extending shaft that extends outwardly from a spider plate that is attached to the rotor. Extending laterally from each sleeve is an extension or pressure member and the operator, through a lever system, can simultaneously exert a downward force against each lever member to thereby tilt the blades in unison to achieve pitch control for the blades.

SUMMARY OF THE INVENTION

The invention is directed to a surface working machine having a novel directional control mechanism that is operated through the pitch control mechanism. In accordance with the invention, the surface working machine includes a frame that carries a plurality of rotors, each having a vertical rotatable shaft. Surface working means, including a plurality of radially extending blades, is operably connected to each shaft and rotates with the shaft.

Each blade is carried by a sleeve, which is mounted for rotation on a horizontal shaft that extends radially from a central spider plate and a pressure member or arm extends laterally from each sleeve.

In accordance with the invention, a ring or swash plate surrounds the rotor shaft and is mounted for limited universal tilting movement with respect to the frame. Pads carried by the pressure members are engaged with the lower surface of the swash plate and rotate relative to the swash plate. Through a manually operated lever system, a downward force can be applied through the swash plate against the pressure members to simultaneously rotate the sleeves and tilt the blades in unison to provide normal pitch control.

In addition, a manually operated cam mechanism, separate from the pitch control lever, is employed to tilt the swash plate relative to the frame, with the result that as each blade rotates through 360° the pitch of the blade is progressively changed to produce a downwardly directed force against the surface to be worked at a location on the periphery of the rotor. By selectively applying the downward force to given locations on the periphery of each rotor of a double-trowel machine, direction control of the machine can be achieved.

The invention provides a simple and effective mechanism for achieving directional control through use of the conventional pitch control mechanism of the machine. With the system of the invention, the rotor is not tilted with respect to the frame, but instead the blades, as they rotate, are selectively tilted about their horizontal axes to achieve directional control.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
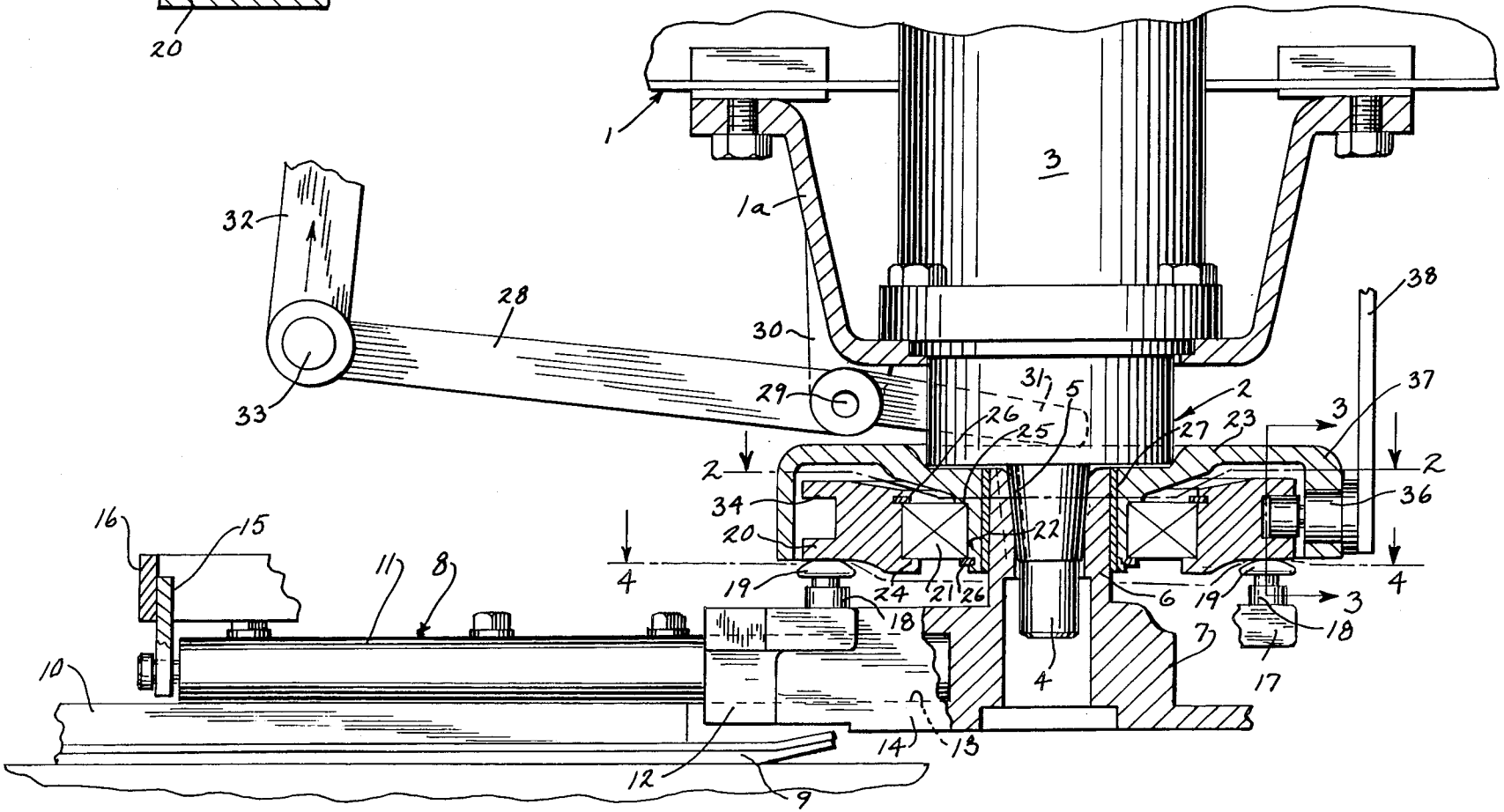
FIG. 1 is a vertical section of a portion of a surface working machine showing the directional control mechanism.

FIG. 1 illustrates a portion of a surface working machine having particular use for trowelling concrete. In the preferred form of the invention, the surface working machine is a riding-type in which an operator will ride on the machine.

The surface working machine comprises a frame 1 that supports a plurality, preferably two, rotors 2. The drawings illustrate only a single rotor 2, and the second rotor is identical in construction to the illustrated rotor and the two rotors are normally oriented in a forward and rear relation on the machine.

Each rotor 2, as shown in FIG. 1, includes a hydraulic motor 3 that is supported by cup-shaped support 1*a* on frame 1. The lower end of drive shaft 4 of motor 3 is connected by key 5 within the central hub 6 of a spider plate 7.

A blade assembly 8 is mounted on spider plate 7 and includes a plurality of trowelling blades 9 that extend radially outward from spider plate 7. Each blade 9 is connected to an upper support bar 10 that is carried by a sleeve 11, and the inner end of sleeve 11 is connected to an annular collar 12. The sleeve 11 and collar 12 of each blade assembly are mounted for rotation about a horizontal shaft 13, which projects outwardly from the respective arm 14 of spider plate 7.

The outer end of each shaft 13 is connected to an upstanding lug 15 and the lugs 15 are secured to a stabilizing ring 16, which is spaced outwardly of the rotor.

Figure 4:
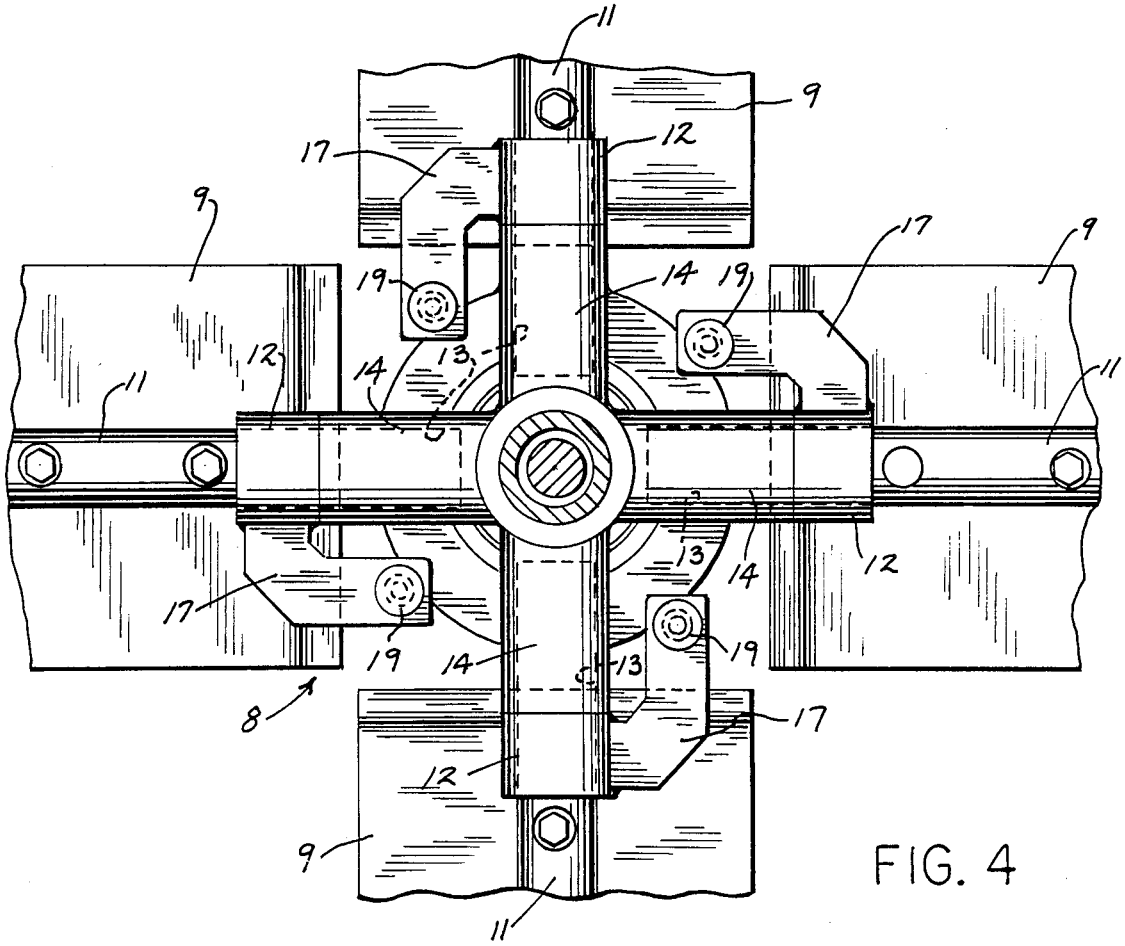
FIG. 4 is a section taken along line 4—4 of FIG. 1.

As best illustrated in FIG. 4, a laterally extending pressure member or arm 17 is connected to each collar 12, and a pad 18 projects upwardly from each pressure member 17 and terminates in a generally rounded head 19. Heads 19 of pads 18 are engaged with the lower surface of a swash plate or ring 20. Swash plate 20 is mounted for rotation by bearing assembly 21 about hub 22 of a fixed cup-shaped support 23 that is connected to frame 1. Bearing assembly 21 not only permits the swash plate to rotate with respect to support 23, but also provides limited universal tilting movement of the swash plate relative to the hub 22.

As best shown in FIG. 1, the lower surface of swash plate 20 is provided with an inwardly extending shoulder 24, which supports the lower end of bearing assembly 21, while the upper end of the bearing assembly 21 is engaged with a shoulder 25 on support 23. Retaining rings 26, which are snap fitted within grooves in the swash plate 20 and support 23, fix the bearing assembly in position relative to these members.

Support 23 is fixed to frame 1 and a bushing 27 is interposed between the hub 22 of support 23 and the hub 6 of spider plate 7 to permit relative rotation between spider plate 7 and fixed support 23.

As shown in FIG. 1, a pitch control arm 28 is pivotally connected by pivot 29 to a lug 30 that extends down from support 1*a* and the inner end 31 of arm 28 bears against the upper surface of support 23, while the outer end of arm 28 is connected to a lever 32 by pin 33. The upper end of lever 32 is connected via a conventional linkage, not shown, to an operating handle or lever located adjacent the operator's seat. Through operation of the handle, the lever 32 can be raised to tilt arm 28. By tilting the outer end of arm 28 upwardly about pivot 30, support 23 will be forced downwardly, thereby simultaneously exerting a downward force on the pressure members 17 to simultaneously rotate sleeves 11 and blades 9 to achieve pitch control for the blades.

Figure 3:
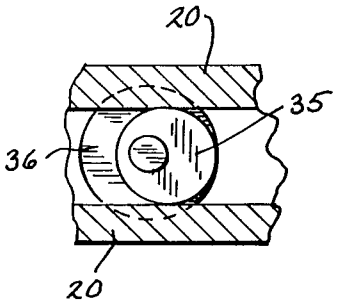
FIG. 3 is a vertical section taken along line 3—3 of FIG. 1.
Figure 2:
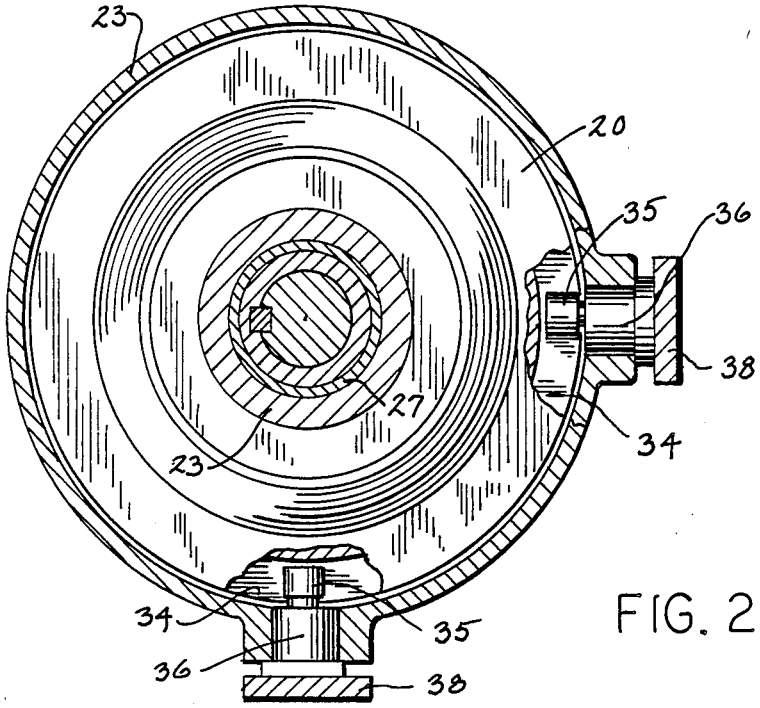
FIG. 2 is a horizontal section taken along line 2—2 of FIG. 1.

In order to obtain directional control for movement of the machine over the surface to be worked, the periphery of swash plate 20 is provided with a groove 34, which receives a pair of cam rollers 35, which are located approximately 90° apart, as shown in FIG. 2. Each cam roller 35 is mounted for rotation on a larger roller 36, which is journalled within an opening in the downwardly extending flange 37 of support 23. As best shown in FIG. 3, the axis of cam roller 35 is offset from the axis of roller 36, so that the roller 35 will function as a cam or eccentric.

A lever 38 is connected to each roller 36, and by pivoting lever 38, cam roller 35 will rotate relative to the axis of roller 36 to tilt swash plate 20. The levers 38 for each rotor extend upwardly and terminate adjacent the operator seat and can be interconnected by a linkage so that they can be operated in unison.

Through manual manipulation of the levers 38, swash plate 20 of each rotor can be tilted. The use of the two cam rollers 35 located at 90° to each other will enable the swash plate 20 to be tilted universally about both a fore and aft, as well as a transverse axis.

In a double trowel machine, the rotors rotate in opposite directions and if the swash plates 20 of the two trowel units are in the same orientation with respect to the longitudinal axis of the machine, there will be no directional movement of the machine, even though the rotors are rotating. By selectively tilting one of the swash plates, through operation of the respective levers 38, the swash plates can be moved out of orientation to provide universal directional movement for the machine.

The blades 9 and associated pads 18 rotate relative to swash plate 20. When the swash plate 20 is tilted, the pitch of each blade will automatically change as it travels through 360°. More specifically, as each blade 9 approaches the downwardly tilted portion of swash plate 20, the blade will be tilted about the axis of shaft 13 to increase the pitch and as the blade approaches the high end of the tilted swash plate, the blade will tilt about axis 13 to decrease the pitch. As the pitch of each blade is increased, a relatively greater downward force is applied, to the surface to be worked and the resulting frictional resistance at a certain location on the periphery of the rotor, will cause directional movement of the rotor. Therefore, by individually tilting the swash plates 20 of each rotor of the double trowel machine, downward pressure can be selectively applied to the surface at given locations around the periphery of each rotor to achieve directional movement of the machine in a conventional manner.

The invention provides a simplified mechanism for achieving directional control of the trowelling machine through use of the conventional pitch control mechanism. In the invention, rotors are not tilted with respect to the frame, but instead, the blades, as they rotate, are changed in pitch to achieve the directional control.

Various modes of carrying out the invention are contemplated as being within the scope of the following claims particularly pointing out and distinctly claiming the subject matter which is regarded as the invention.

I claim:

1. A surface working machine, comprising a frame, at least one rotor mounted on the frame and including a rotatable vertical shaft, surface working means operably connected to said shaft and including a plurality of radially extending blade means disposed to contact a surface to be worked as said rotor rotates, each blade means being mounted for tilting movement about a horizontal axis, first operating means for simultaneously tilting each blade means about the respective horizontal axis to vary the pitch of the blade means in unison, and second operating means for individually tilting each blade means about the respective horizontal axis as said rotor rotates to effect directional control of the machine, while the motor is maintained in a vertical orientation.

2. The machine of claim 1, wherein each blade means includes a blade and a pressure member extending laterally from each blade, said first operating means including lever means operably connected to said pressure members to simultaneously exert a downward force on said pressure members to tilt the blades in unison.

3. The machine of claim 1, wherein said second operating means comprises adjustable cam means, each of said blade means being disposed in engagement with said cam means and disposed to rotate relative thereto, rotation of each blade means relative to said cam means causing the pitch of each blade means to be individually varied.

4. The machine of claim 3, wherein said adjustable cam means comprises an annular swash plate disposed radially outward of said shaft, said swash plate being mounted for universal tilting movement relative to said frame, and pivoting means for pivoting said plate with respect to a horizontal plane.

5. The machine of claim 4, wherein said pivoting means comprises a manually actuated operating member connected to said swash plate.

6. The machine of claim 5, wherein said plate is provided with a peripheral groove and said pivoting means comprises an eccentrically mounted roller received within said groove and operably connected to said operating member.

7. A surface working machine, comprising a frame having a hub, at least one rotor means carried by the frame and including a rotatable vertical shaft, surface working means operably connected to said shaft and including a plurality of radially extending blades, each blade being mounted for tilting movement about a horizontal axis, a pressure member extending laterally from each blade, first operating means for simultaneously exerting a downward force against said pressure members to simultaneously tilt said blades about the respective horizontal axis and effect pitch control for the blades, and second operating means for sequentially exerting a downward force on said pressure members as said rotor rotates to individually tilt said blades about said axes and effect directional control of the machine, while the rotor is maintained in a vertical orientation.

8. The machine of claim 7, wherein said second operating means comprises a ring disposed radially outward of said shaft, means for mounting said ring for universal tilting movement with respect to said hub, said ring being disposed in engagement with said pressure members, and means for pivoting said ring relative to said hub.

9. The machine of claim 8, wherein said means for pivoting tilting comprises an operating member pivotally mounted with respect to said frame, said ring having a peripheral groove, and a follower connected to said operating member and disposed within said groove, said follower comprising a roller offset from the pivotal connection of said operating member to said frame, pivotal movement of said operating member causing tilting of said ring.

10. The machine of claim 9, and including a pair of followers disposed in said groove, said followers being spaced approximately 90° apart.

11. The machine of claim 8, and including a pad on said pressure member and disposed in engagement with the lower surface of said ring.

12. The machine of claim 7, wherein said rotor includes four blades, and a pressure member associated with each blade.

13. A surface working machine, comprising a frame, at least one rotor mounted on the frame and including a rotatable shaft, surface working means operably connected to said shaft and including a plurality of radially extending blade means disposed to contact a surface to be worked as said rotor rotates, each blade means being mounted for tilting movement about a horizontal axis to vary the pitch of said blade means, and means for individually varying the pitch of each blade means as said rotor rotates to thereby vary the downward pressure applied by each blade means against said surface and achieve directional control for said machine, while the rotor is maintained in a vertical orientation.

14. A surface working machine, comprising a frame, a pair of rotors mounted on the frame and each rotor including a rotatable shaft, surface working means operably connected to said shaft and including a plurality of radially extending blades disposesd to contact a surface to be worked as said rotor rotates, means for mounting each blade for tilting movement about a horizontal axis to vary the pitch of said blade relative to said surface, and means for individually varying the pitch of each blade as each rotor rotates to thereby vary the downward pressure applied by each blade against said surface, the selective individual variation of pitch of said blades of each rotor causing directional change of said machine, while each of the rotors are maintained in a vertical orientation.

* * * * *

UNITED STATES PATENT AND TRADEMARK OFFICE

CERTIFICATE OF CORRECTION

PATENT NO. : 4,784,519

DATED : November 15, 1988

INVENTOR(S) : Thomas G. Artzberger

It is certified that error appears in the above-identified patent and that said Letters Patent is hereby corrected as shown below:

IN THE CLAIMS: Col. 4, line 44, delete "motor" and substitute therefor ---rotor---; Col. 5, line 30, delete "tilting"; Col. 6, line 27, delete "disposesd" and substitute therefor ---disposed---

Signed and Sealed this

Nineteenth Day of December, 1989

*Attest:*

JEFFREY M. SAMUELS

*Attesting Officer* *Acting Commissioner of Patents and Trademarks*